United States Patent [19]

Burke et al.

[11] Patent Number: 4,512,587

[45] Date of Patent: Apr. 23, 1985

[54] AEROSOL CANNISTER FITTING

[75] Inventors: James W. Burke, Long Grove, Ill.; John D. Krueger, Brookwood, Wis.; John W. Krueger, Glenview, Ill.

[73] Assignee: Krubur, Inc., Algonquin, Ill.

[21] Appl. No.: 882,202

[22] Filed: Feb. 28, 1978 (Under 37 CFR 1.47)

[51] Int. Cl.[3] ..... F10J 15/18

[52] U.S. Cl. ..... 277/205; 123/187.5 R; 222/504

[58] Field of Search ..... 285/110, 111, 198; 123/187.5, 180 R; 277/188 R, 277, 205; 222/504

[56] References Cited

U.S. PATENT DOCUMENTS

| | | | |
|---|---|---|---|
| 2,509,436 | 5/1950 | Isenbarger | 277/188 R |
| 2,964,246 | 12/1960 | Alholm | 222/504 |
| 2,986,135 | 5/1961 | Clark et al. | 123/180 R |
| 3,148,670 | 9/1964 | Fiedler et al. | 123/187.5 R |
| 3,160,331 | 12/1964 | Trumbull | 222/504 |
| 3,162,469 | 12/1964 | Shohan | 285/111 |
| 3,552,369 | 1/1971 | Frisch | 123/187.5 |
| 3,661,133 | 5/1972 | Rasch | 123/180 R |
| 3,680,874 | 8/1972 | Schwarz | 277/205 |
| 3,790,119 | 2/1974 | Scannell | 277/205 |
| 4,088,247 | 5/1978 | Hickman | 222/504 |
| 4,166,441 | 9/1979 | Grigsby | 123/180 R |

*Primary Examiner*—Robert I. Smith

*Attorney, Agent, or Firm*—Willian Brinks Olds Hofer Gilson & Lione Ltd.

[57] ABSTRACT

An improved fitting is disclosed for receiving and sealing an aerosol cannister. This fitting employs an annular sealing ring on the fitting to seal against one or more peripheral surfaces of the recess defined by the valve assembly of the aerosol cannister.

19 Claims, 5 Drawing Figures

AEROSOL CANNISTER FITTING

BACKGROUND OF THE INVENTION

The present invention is directed to an improved fitting for receiving and sealing an aerosol cannister.

Aerosol cannisters are widely used as disposable containers for a range of materials. In many applications, these cannisters are used in connection with a mounting bracket which secures the cannister in such a way that a valve fitting on the mounting bracket is sealed against a valve assembly of the cannister. For example, one such application is in connection with devices for injecting an ether based fuel into a diesel engine to improve the cold start characteristics of the engine. Ether based fuel is available in aerosol cannisters, and one type of ether injection device uses a mounting bracket to mount an aerosol cannister which supplies ether based fuel to the engine. Typically, some type of valve actuator is provided to control the release of ether from the cannister through the valve fitting into the engine.

In the past, such mounting brackets have been designed to press the cannister firmly against a gasket in the valve fitting. It is contact with this gasket that seals the valve assembly of the cannister to the valve fitting and retards leakage when ether is discharged out of the cannister into the fitting.

Such gasket type fittings exhibit certain disadvantages. The sealing action of a gasket requires that the cannister be firmly pressed against the gasket, and the mounting bracket used with a gasket type fitting must be relatively substantial and capable of providing the needed sealing force. This may require the use of a heavier and more costly mounting bracket than would otherwise be desirable. Such gasket type fittings may be subject to leakage if adequate sealing force is not constantly applied. For example, the gasket may be gradually deformed by the sealing force to the point where the sealing force is excessively reduced. Moreover, it is often the uppermost, most exposed portion of the aerosol cannister which is pressed against the gasket to provide the seal, and nicks or dents in this exposed surface may prevent the formation of an adequate seal.

SUMMARY OF THE INVENTION

The present invention is directed to an improved fitting which does not rely on a gasket type seal in order to create an effective seal with an aerosol cannister.

Generally, aerosol cannisters are provided with an exit port which is surrounded by an annular recess defined in part by a perimeter surface included in the valve assembly of the cannister. The fitting of the present invention includes an annular fitting member adapted to fit into this recess. This fitting member is provided with an annular seal member which is adapted to seal the fitting member to a portion of the perimeter surface.

The perimeter surface actually includes inner and outer perimeter surfaces which form the inner and outer limits, respectively, of the annular recess surrounding the exit port. The seal member of this invention may be designed to seal against either of these portions of the perimeter surface. Alternately, a plurality of seal members may be used to seal the fitting member to both the inner and outer perimeter surfaces of the aerosol cannister valve assembly.

The improved fitting of the present invention provides several advantages over the gasket type fittings of the prior art. Since the seal is achieved by confining the sealing member between the fitting member and a peripheral surface of the valve assembly, the seal is not dependent on an external sealing force applied to the cannister. Therefore, a relatively inexpensive mounting bracket may be used with this fitting which supplies only a restraining force to hold the cannister in the fitting rather than a sealing force. Furthermore, leakage is less likely to result from a decrease in the force with which the bracket holds the cannister in place. Moreover, the peripheral surface of the cannister is used to create the seal, and this surface is relatively protected and less subject to deformation as compared with the uppermost surface of the cannister, which is often used in gasket type seals.

The invention, together with further objects and attendant advantages will be best understood by reference to the following detailed description taken in connection with the appended drawings.

DETAILED DESCRIPTION OF PREFERRED EMBODIMENTS

Figure 1:
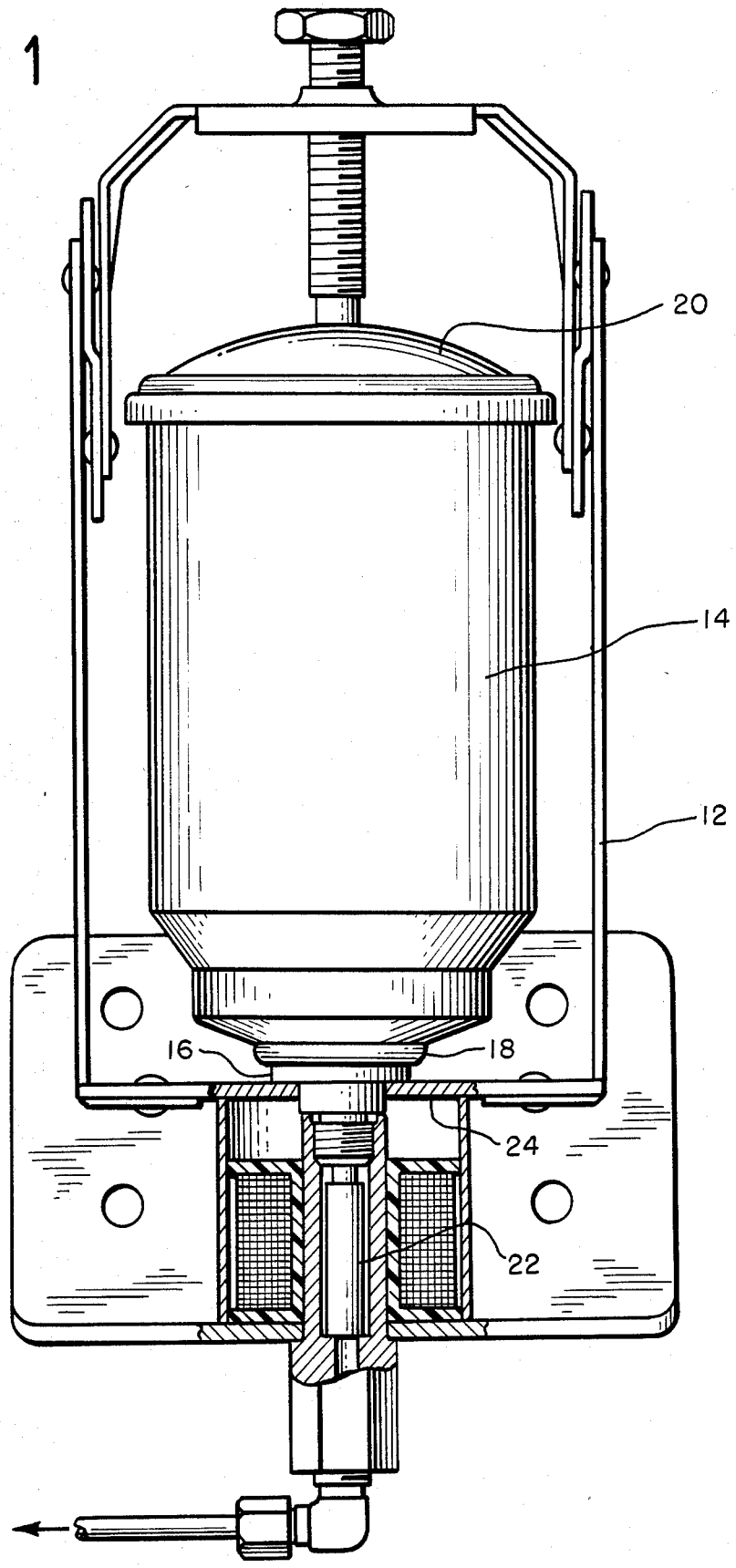
FIG. 1 is an elevational view of an aerosol cannister secured by a mounting bracket to a fitting embodying the features of the present invention.

Referring now to the drawings, there is illustrated in FIG. 1 an aerosol cannister 14 mounted in a bracket 12. The bracket includes a valve actuator 22 and a fitting 16 secured to a mounting plate 24. An adjustable retainer 20 provides a retaining force holding the cannister 14 in place in the fitting 16. The fitting 16 provides a seal against the valve assembly 18 of the cannister 14 which prevents undue leakage when the contents of the cannister 14 are released into the fitting 16 by the valve actuator 22. The present invention is directed to an improved sealing arrangement embodied in the fitting 16.

Figure 2:
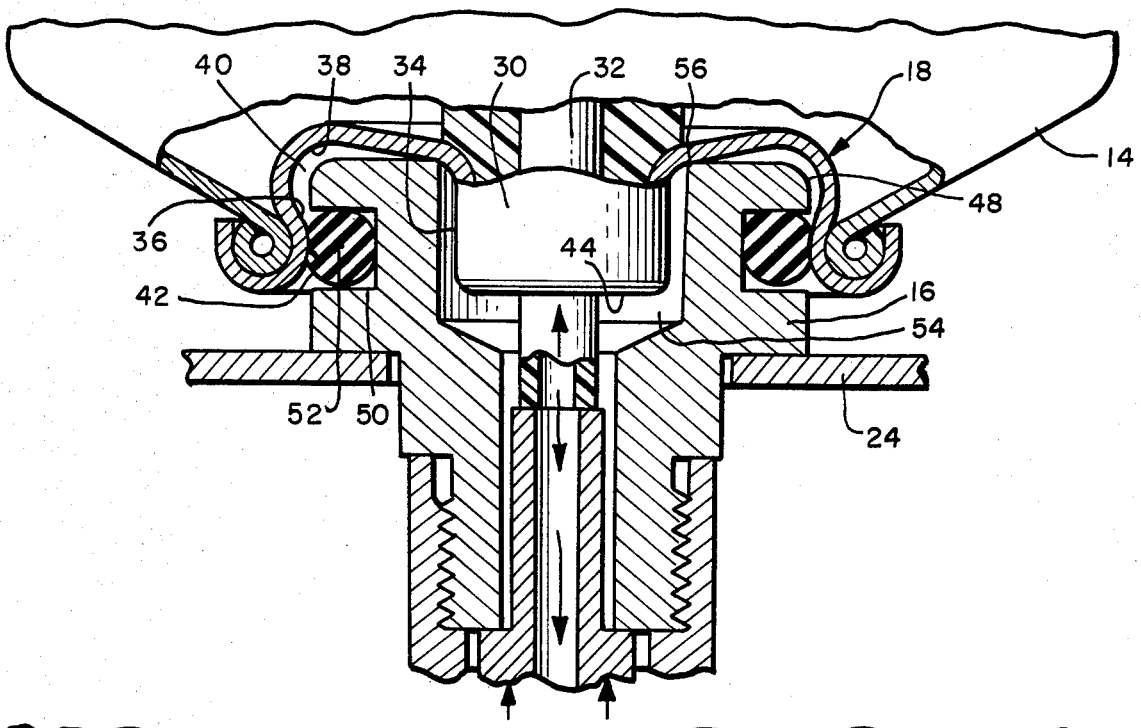
FIG. 2 is an enlarged cross-sectional view of the fitting of FIG. 1.

FIG. 2 presents an enlarged cross-sectional view of the fitting 16 and a portion of the cannister 14. Cannisters such as the aerosol cannister 14 are generally available, and include a valve assembly at the uppermost portion of the cannister. As shown in FIG. 2 the valve assembly 18 includes a centrally located exit port 32 through which the contents of the cannister may be released. The valve assembly 18 also includes a cylindrically shaped element 30 which concentrically surrounds a portion of the exit port 32. The central element 30 defines an inner peripheral surface 34 which cooperates with the floor surface 38 and the outer peripheral surface 36 to define a concentric annular recess 40 in the valve assembly 18. The central element 30 also defines an upper surface 44. A sealing region 42 is defined in the outer peripheral surface 36 near the outermost edge of the recess 40. This sealing region 42 is a substantially circular region concentric with the exit port 32 and is generally formed with a curved cross-section as shown.

The fitting 16 is an annular element defining a central cavity 54 which is sized to receive the central element 30. Because the diameter of the outer surface 48 of the fitting 16 is somewhat smaller than the diameter of the sealing region 42, the fitting 16 fits into the annular recess 40. The fitting 16 also defines an upper surface 56 which contacts the floor surface 38 when the fitting 16 is maximally inserted into the recess 40.

An annular recess 50 is formed in the outer surface 48 and serves as an outer gland for the O-ring seal 52. The O-ring seal 52 is a toroidally shaped elastomeric element which forms a seal between the sealing surface 42 and the fitting 16.

It has been found that, for many aerosol cannisters from a variety of sources, the diameter of the sealing surface 42 is substantially constant. Therefore, one fitting 16 equipped with a properly sized O-ring seal 52 will effectively seal a range of different aerosol cannisters. Because the cross-section of the sealing surface 42 defines a convex radius the preferred depth of the outer gland 50 is less than that customarily used in O-ring glands designed for use with cylindrical sealing surfaces. The reduced depth of the outer gland 50 insures increased contact area between the O-ring seal 52 and the sealing surface 42, and thereby improves the sealing characteristics of the O-ring seal 52.

Figure 3:
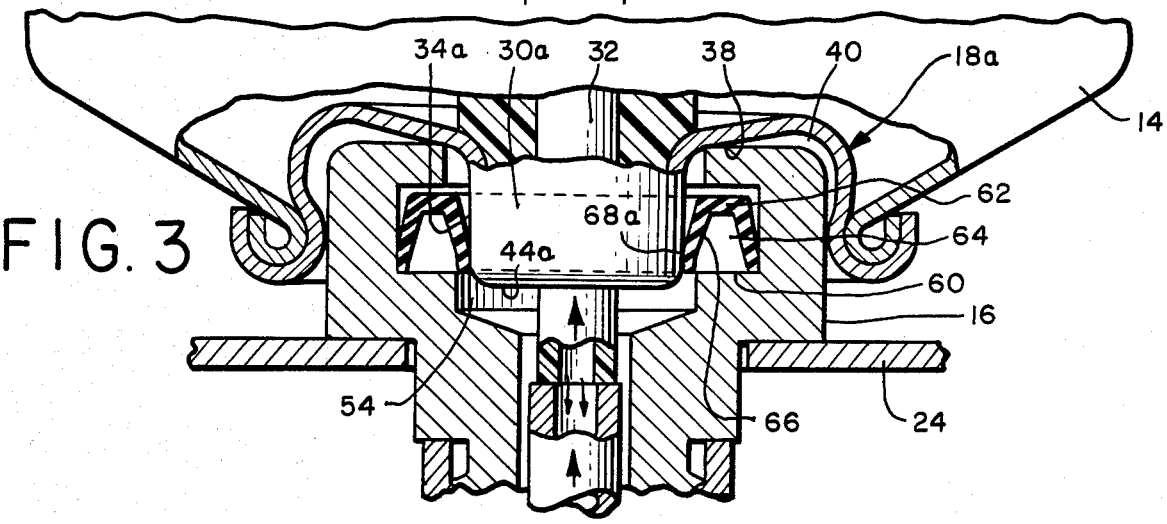
FIG. 3 is an enlarged cross-sectional view of an alternate embodiment of the fitting of FIG. 1, showing a first aerosol cannister mounted on the fitting.
Figure 4:
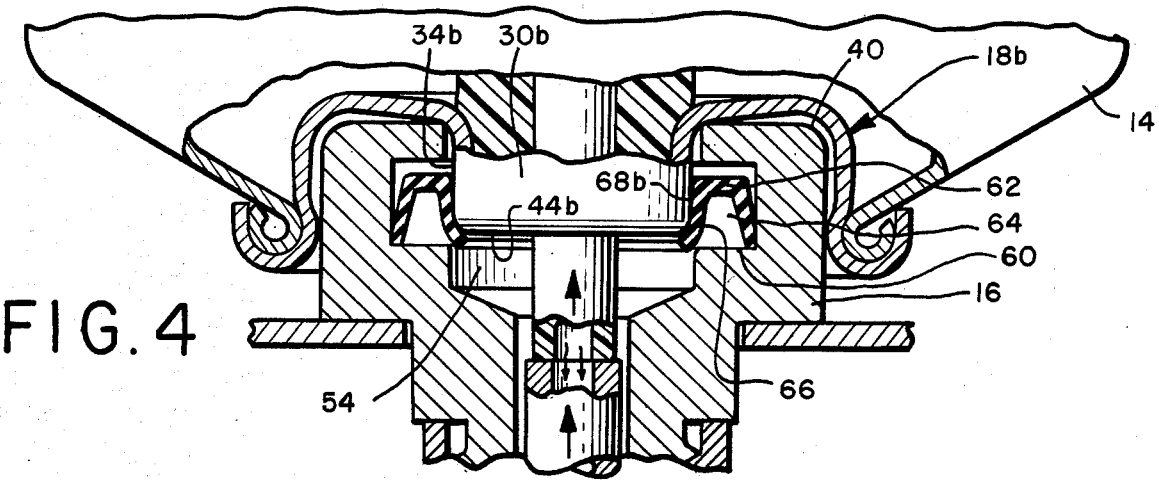
FIG. 4 is an enlarged cross-sectional view of the fitting of FIG. 3, showing a second aerosol cannister mounted on the fitting.

FIGS. 3 and 4 depict a second preferred embodiment of the fitting 16 which seals against the inner peripheral surface of the valve assembly instead of the outer peripheral surface. The fitting 16 of FIGS. 3 and 4 is identical to that of FIG. 2 except that an inner gland 60 is formed in the fitting 16 instead of the outer gland 50. An annular cupped sealing ring 62 formed from a resilient elastomeric compound is disposed within the inner gland 60. The cupped sealing ring 62 defines an annular trough 64 which faces away from the aerosol cannister 14. The inner lip 66 of the sealing member 62 is disposed at an angle with respect to the axial direction defined by the exit port 32, and the inside diameter of the lip 66 is larger near the opening than at the base of the trough 64.

It has been found that a large number of aerosol cannisters include one of two types of valve assemblies 18. These two types, which are illustrated in FIGS. 3 and 4, differ principally in the dimensions of the central element 30. FIG. 3 shows a valve assembly **18*a* having a central element 30*a* which is comparatively tall and narrow. That is, the distance between the floor surface 38 and the upper surface 44*a* is comparatively large, and the diameter of the inner peripheral surface 34*a* is comparatively small. FIG. 4 shows a valve assembly 18*b* which includes a central element 30*b*, defined by upper surface 44*b* and inner peripheral surface 34*b***, which is comparatively short and wide.

The cupped sealing ring 62 is shaped to provide an effective seal against both the central element **30*a* of FIG. 3 and the central element 30*b* of FIG. 4. As mentioned previously, the inner lip 66 is disposed at an angle. This angle is chosen so that the sealing surface 68*a* between the inner lip 66 and the central element 30*a* is near the opening to the trough 64. The shape of the sealing ring 62 also determines the location of the sealing surface 68*b*, between the inner lip 66 and the central element 30*b*, which is near the base of the sealing member 62 where the inside diameter of the inner lip 66 is larger. Because the central element 30*a* is both higher and narrower than the central element 30*b*, a single fitting incorporating one cupped sealing ring 62** provides an effective seal against both.

A further advantage of the cupped sealing ring 62 is derived from its U-shaped cross-section. When material such as ether is released from the cannister 14 through the exit port 32 the pressure in the central cavity 54 of the fitting rises. This increased pressure acts on the cupped sealing ring 62 to urge the inner lip 66 more tightly against the central element **30*a* or 30*b***, thereby improving the seal therebetween.

Figure 5:
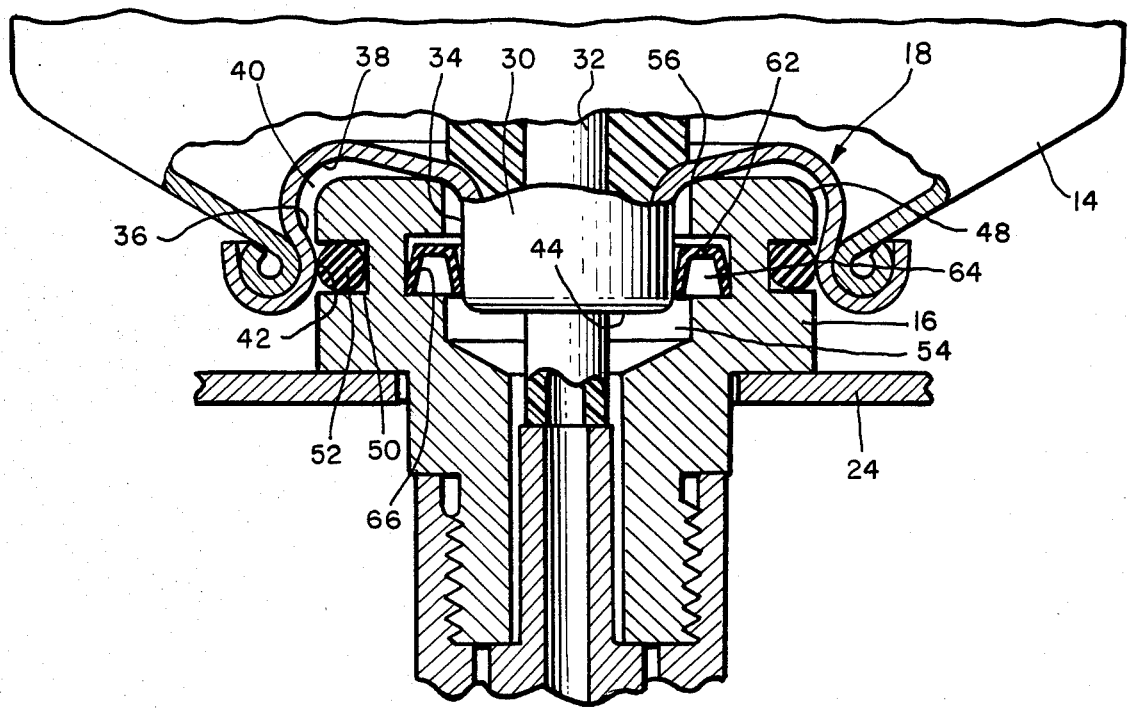
FIG. 5 is an enlarged cross-sectional view of a third preferred embodiment of the fitting of FIG. 1.

The sealing features of the fittings illustrated in FIGS. 2, 3 and 4 may be combined to produce a fitting FIG. 5 with further sealing advantages. Such a fitting includes both an inner gland 60 with a cupped sealing ring 62 and an outer gland 50 with an O-ring seal 52. This double seal fitting provides two independent seals. Furthermore, the O-ring seal 52 protects the cupped sealing ring 62 against contamination. In some environments the fitting 16 of FIGS. 3 and 4 may be subject to fouling which may interfere with the seal between the sealing ring 62 and the valve assembly **18*a* or 18*b*. Contaminating material may migrate into the recess 40 and from there into the central cavity 54 and into contact with the sealing ring 62. The double seal fitting described above substantially prevents this fouling by preventing the migration of foreign material into the recess 40**.

The elastomer used for the O-ring 52 and the cupped sealing ring 62 should be chosen to be chemically resistant to the material contained in the cannister. For example, fittings designed for use with ether based fuels should include seals made from an ether resistant compound such as polysulfide rubber.

Of course, it should be understood that various changes and modifications to the preferred embodiments described herein will be apparent to those skilled in the art. Such changes and modifications can be made without departing from the scope of the present invention, and without diminishing its attendant advantages, and are intended to be covered by the following claims.

We claim:

1. A fitting adapted to receive and seal an aerosol cannister valve assembly, said assembly having an exit port and a perimeter surface which cooperates with a floor surface to define a recess surrounding the exit port, said fitting comprising:

an annular fitting member adapted to fit into the recess; and an annular sealing member disposed on the fitting member, said sealing member sized to contact both the fitting member and a portion of the perimeter surface such that the sealing member is compressed between the fitting member and the portion of the perimeter surface to provide a substantially fluid tight, static seal between the fitting member and the portion of the perimeter surface of the valve assembly.

2. The fitting of claim 1 wherein the sealing member includes an O-ring seal adapted to sealingly contact a portion of the perimeter surface.

3. The fitting of claim 1 wherein the sealing member includes a cupped sealing ring adapted to sealingly contact a portion of the perimeter surface.

4. The fitting of claim 1 or 3 wherein the fitting member is formed of a substantially rigid material and the fitting member defines a circular groove sized to receive and confine the annular sealing member.

5. A fitting adapted to receive and seal an aerosol cannister valve assembly, said assembly having an exit port and a floor surface which cooperates with an outer and an inner peripheral surface to define an annnular recess surrounding the exit port, said fitting comprising:

an annular fitting member adapted to fit into the recess; and a cupped sealing ring disposed on the fitting member, said sealing ring sized to contact both the fitting member and a portion of the perimeter surface such that the sealing ring is compressed beteen the fitting member and the portion of the perimeter surface to provide a substantially fluid tight, static seal between the fitting and the portion of the inner peripheral surface substantially independently of the force with which the fitting member is urged toward the floor surface.

6. The fitting of claim 5 further comprising an O-ring seal disposed on the fitting member adapted to provide a seal between the fitting and the outer peripheral surface.

7. A fitting adapted to receive and seal an aerosol cannister valve assembly, said assembly having an exit port and a floor surface which cooperates with an outer and an inner peripheral surface to define an annular recess surrounding the exit port, said fitting comprising:

an annular fitting member adapted to fit into the recess; and an O-ring seal disposed on the fitting member adapted to provide a seal between the fitting and a portion of the outer peripheral surface.

8. The fitting of claim 7 further comprising a cupped sealing ring disposed on the fitting member adapted to provide a seal between the fitting and a portion of the inner peripheral surface.

9. A fitting adapted to receive and seal an aerosol cannister valve assembly, said assembly having an exit port and a floor surface which cooperates with an outer and an inner peripheral surface to define an annular recess surrounding the exit port, said fitting comprising:

an annular fitting member adapted to fit into the recess, said fitting defining inner and outer surfaces;

an annular inner gland formed on the inner surface of the fitting member;

a cupped sealing ring disposed in the gland to provide a seal between the fitting and a portion of the inner peripheral surface, said sealing ring defining an inner sealing lip disposed at an angle to the direction defined by the exit port when the exit port is received into the fitting;

an annular outer gland formed on the outer surface of the fitting member; and an O-ring seal disposed in the outer gland to provide a seal between the fitting and a portion of the outer peripheral surface.

10. A fitting adapted to receive and seal an aerosol cannister valve assembly, said assembly having an exit port and a floor surface which cooperates with an outer and an inner peripheral surface to define an annular recess surrounding the exit port, said fitting comprising:

a substantially rigid annular fitting member sized to fit within the recess, said fitting defining an annular groove positioned adjacent one of the inner and outer peripheral surfaces when the fitting member is placed within the recess;

a resilient, annular sealing member disposed within the groove, said sealing member sized to contact both the fitting member and an annular portion of the one of the inner and outer peripheral surfaces when the fitting member is placed within the recess such that the sealing member is confined between the fitting member and the annular portion to create a substantially fluid tight, static seal which is substantially independent of the force with which the fitting member is urged toward the floor surface.

11. The fitting of claim 10 wherein the one of the inner and outer peripheral surfaces is the inner peripheral surface.

12. The fitting of claim 11 wherein the sealing member is a cupped sealing ring.

13. The combination of an aerosol cannister and a fitting sealed thereto, said combination comprising:

an aerosol cannister comprising a valve assembly, said assembly having an exit port and a perimeter surface which cooperates with a floor surface to define a recess surrounding the exit port;

an annular fitting member positioned in the recess; and an annular sealing member disposed on the fitting member, said sealing member sized to contact both the fitting member and a portion of the perimeter surface such that the sealing member is compressed between the fitting member and the portion of the perimeter surface to provide a substantially fluid tight, static seal between the fitting member and the portion of the perimeter surface of the valve assembly.

14. The invention of claim 13 wherein the sealing member comprises a cupped sealing ring adapted to sealingly contact a portion of the perimeter surface.

15. The combination of an aerosol cannister and a fitting sealed thereto, said combination comprising:

an aerosol cannister comprising a valve assembly, said assembly having an exit port and a floor surface which cooperates with an outer and an inner peripheral surface to define an annular recess surrounding the exit port;

an annular fitting member positioned in the recess; and a cupped sealing ring disposed on the fitting member, said sealing ring sized to contact both the fitting member and a portion of the perimeter surface such that the sealing ring is compressed between the fitting member and the portion of the perimeter surface to provide a substantially fluid tight, static seal between the fitting and the portion of the inner peripheral surface substantially independently of the force with which the fitting member is urged toward the floor surface.

16. The invention of claim 13 or 14 wherein the fitting member is formed of a substantially rigid material and the fitting member defines a circular groove sized to receive and confine the annular sealing member.

17. The combination of an aerosol cannister and a fitting sealed thereto, said combination comprising:

an aerosol cannister comprising a valve assembly, said assembly having an exit port and a floor surface which cooperates with an inner and an outer peripheral surface to define an annular recess surrounding the exit port;

a substantially rigid annnular fitting member positioned in the recess, said fitting defining an annular groove positioned adjacent one of the inner and outer peripheral surfaces; and a resilient, annular sealing member disposed within the groove, said sealing member sized to contact both the fitting member and an annular portion of the one of the inner and outer peripheral surfaces such that the sealing member is confined between the fitting member and the annular portion to create a substantially fluid tight, static seal which is substantially independent of the force with which the fitting member is urged toward the floor surface.

18. The invention of claim 17 wherein the one of the inner and outer peripheral surfaces is the inner peripheral surface.

19. The invention of claim 17 wherein the sealing member is a cupped sealing ring.

* * * * *